US005966559A

United States Patent [19]

May et al.

[11] Patent Number: 5,966,559

[45] Date of Patent: Oct. 12, 1999

[54] METHOD AND APPARATUS FOR SENSING AND ACCOMODATING DIFFERENT THICKNESS PAPER STOCKS IN AN ELECTROSTATOGRAPHIC MACHINE

[75] Inventors: John W. May, Rochester; Donald S. Rimai, Webster; Christopher B. Liston, Rochester, all of N.Y.

[73] Assignee: Eastman Kodak Company, Rochester, N.Y.

[21] Appl. No.: 08/935,425

[22] Filed: Sep. 23, 1997

[51] Int. Cl.[6] ..... G03G 15/00; G03G 15/16

[52] U.S. Cl. ..... 399/45; 399/303; 399/313; 399/389

[58] Field of Search ..... 399/45, 303, 297–299, 399/311–313, 388, 389

[56] References Cited

U.S. PATENT DOCUMENTS

| | | | |
|---|---|---|---|
| 4,078,929 | 3/1978 | Gundlach | 96/1.2 |
| 4,342,936 | 8/1982 | Marcus et al. | 310/330 |
| 5,084,735 | 1/1992 | Rimai et al. | 399/302 |
| 5,127,643 | 7/1992 | DeSanctis et al. | 271/9 |
| 5,138,178 | 8/1992 | Wong et al. | 399/45 X |
| 5,187,526 | 2/1993 | Zaretsky | 399/302 |
| 5,191,378 | 3/1993 | Itaya et al. | 399/313 |
| 5,486,903 | 1/1996 | Kanno et al. | 399/45 |
| 5,504,565 | 4/1996 | Tomiki et al. | 399/297 |
| 5,572,309 | 11/1996 | Nishio et al. | 399/389 |
| 5,689,758 | 11/1997 | Wataki et al. | 399/45 |
| 5,758,244 | 5/1998 | Iwakura | 399/313 |

FOREIGN PATENT DOCUMENTS 58-48082 3/1983 Japan .

OTHER PUBLICATIONS

IS&T's Sixth International Congress on Advances in Non–Impact Printing Technologies, pp. 101–110, published in 1990, in the name of Miskinis.

*Primary Examiner*—William Royer
*Attorney, Agent, or Firm*—Norman Rushefsky

[57] ABSTRACT

A recording apparatus includes a toner image bearing member and a transfer backing member that define a transfer nip. Pressure is applied in the transfer nip to a receiver member that is in engagement with the toner image bearing member for transfer of a toner image on the toner image bearing member to the receiver member. A sensor senses a parameter related to thickness of the receiver member prior to movement of the receiver member into the nip. An adjustment device is responsive to sensing of the parameter and adjusts nip spacing between the toner image bearing member and the transfer backing member.

17 Claims, 4 Drawing Sheets

METHOD AND APPARATUS FOR SENSING AND ACCOMODATING DIFFERENT THICKNESS PAPER STOCKS IN AN ELECTROSTATOGRAPHIC MACHINE

FIELD OF THE INVENTION

This invention relates to an electrostatographic apparatus and method. In particular, this invention relates to an apparatus and method for the improved transfer of images to receiver sheets of different thicknesses.

BACKGROUND OF THE INVENTION

In a typical electrostatographic machine using, for example, an electrophotographic process, an image is generated by first charging a photoconductive element and generating an electrostatic latent image by image-wise exposing the electrostatic latent image using either an optical or an electro-optical exposure system, such as a laser scanner or LED array. The electrostatic latent image is then developed into a visible image by bringing the latent image bearing photoconductive element into contact with an appropriate developer. Most commonly, so-called "two-component developers", comprising electrostatically charged marking or toner particles and oppositely charged nonmarking or carrier particles, are used, although mono-component developers are also used. The image is transferred to a receiver sheet such as paper or transparency stock using suitable means such as by applying an electrostatic field so as to urge the toner particles from the photoconductive member to the receiver sheet. The image is then permanently fixed to the receiver sheet by a known suitable process such as fusing, while the photoconductive element is cleaned and made ready for reuse. Color images are generally made by producing latent images corresponding to separations of the primary colors (e.g. cyan, magenta, yellow, and black) and transferring them sequentially, in register, to the receiver sheet. Alternatively, it is known to form two-color images in an image frame of a photoconductive element and transfer the images simultaneously to a receiver sheet; see for example, Gundlach U.S. Pat. No. 4,078,929.

It is often advantageous to transfer toner images initially formed on the photoconductive element or other primary toner image forming member to an intermediate member first and subsequently transfer the toner images to the receiver sheet. In this instance, color images (including so-called "spot-color" images) are prepared generally by transferring all separation toner images sequentially, in register, to the intermediate member and, subsequently, transferring the image from the intermediate member to the receiver sheet. However, under some circumstances, it may be desirable to transfer separations to the intermediate or separate intermediates, and register the separations during the transfer to the receiver sheet.

Of particular interest is the use of electrophotographic apparatus comprising a compliant transfer intermediate, as described in the patents by Zaretsky, U.S. Pat. No. 5,187,256, and Rimai et al, U.S. Pat. No. 5,084,735. These intermediates typically comprise an electrically conducting cylindrical core, such as aluminum, overcoated with a semi-insulating elastomeric blanket. Further, these intermediates have a thin relatively hard overcoat of thickness no more than about 30 $\mu$m comprised of a material which serves to control particle adhesion. Such a structure has been found to be beneficial in reducing transfer generated image artifacts such as hollow character (the failure to transfer the centers of fine lines) and halo (the failure to transfer toned regions adjacent to high density areas). In addition the use of compliant transfer intermediates has been shown to be of value when transferring images comprised of small size toner particles (i.e. mean volume weighted diameters between about 2 $\mu$m and about 9 $\mu$m). Mean volume weighted diameter of toner particles may be measured by conventional diameter measuring devices such as a Coulter Multisizer, sold by Coulter, Inc. Mean volume weighted diameter is the sum of the mass of each particle times the diameter of a spherical particle of equal mass and density, divided by total particle mass.

In the preferred embodiments described herein, transfer of toner images is made from a toner bearing compliant image member (TBCIM) to a receiver sheet or member such as paper or plastic transparency. For the purpose of this specification, a TBCIM is defined as an image bearing member comprising a polymeric layer not less than 1 mm in thickness, said layer having a Young's modulus between 0.5 MPa and 50 MPa. (MPa are mega Pascals or $10^6$ Newtons/meter$^2$). Polymers having such properties are frequently referred to as elastomers and, for the purpose of this specification, elastomers are defined as such. A TBCIM can comprise a primary image forming member such as a photoconductor such as that disclosed by Tombs and May in U.S. application Ser. No. 08/655,787. Alternatively, it can comprise a compliant intermediate transfer member such as those disclosed by Rimai and Zaretsky referred to above. Preferred TBCIMs are described in U.S. application Ser. No. 08/846,056, filed in the name of Vreeland et al. Transfer, in general, occurs in the nip region formed between the TBCIM and a backup roller or other pressure application device located behind the receiver sheet.

A well known property of elastomers such as those used in a TBCIM is often described by the principle of time-temperature superposition. According to this principle, a polymer, which behaves as an elastomer under normal conditions, appears quite rigid or glassy under conditions where it is subjected to a sudden force or impact by another object. Specifically, under impact conditions, a typical elastomer would behave like a material having a Young's modulus of approximately 3 GPa. Such an impact is often caused by a receiver sheet entering a transfer nip region. A material with that effective magnitude of Young's modulus would not be able to rapidly conform to the receiver. Because of the mass of the intermediate, this impact can jar or momentarily stall the machine, thereby adversely affecting image quality. In particular it can cause the separations to be misregistered during the transfer process. Moreover, in some applications, such impacts can adversely affect the timing of the engine, thereby creating user-observable artifacts in the final image, as well as causing general wear and tear to the engine.

Although the previous discussion relates principally to a drum intermediate, it can also apply to a web intermediate, especially if additional pressure is applied to the web intermediate member during transfer by use of a back-up roller. Similarly, it can also apply to a web or drum compliant primary image member.

There are many receivers used in electrophotographic engines. These receivers may have vastly different physical properties. One such property is the thickness of the receiver member or receiver sheet which generally varies from less than 75 $\mu$m to well over 250 $\mu$m. The use of an intermediate transfer member with a single imaging member eliminates the need to wrap the receiver around a drum to produce color images and, thereby, facilitates the use of even much thicker stock (over 0.5 cm thick). Receiver sheet thickness can vary between jobs or even within a job, as would be the case where booklets with covers are being prepared. A thick receiver sheet can create a substantial impact upon entering the transfer nip, as previously discussed.

Not only can undesirable impulse shocks adversely affect output image quality, but they can also adversely affect the reliability and life of a transfer station, including the TBCIM.

There is a need to minimize mechanical disturbances caused by receiver members in a transfer station, e.g., in a production machine in which papers of different thicknesses are needed for different job streams, or when receiver member thickness changes abruptly within a particular job stream.

SUMMARY OF INVENTION

In the apparatus and method of the present invention, there is automatic sensing of the thickness of the receiver member prior to entering the transfer nip. Information relative to thickness of the receiver member is used to control the gap spacing and hence the pressure between a toner image bearing member and a backing member so as to facilitate the entrance of the receiver member into the transfer nip and to eliminate or reduce the impacts associated with the receiver member entering and exiting the transfer nip.

BRIEF DESCRIPTION OF THE DRAWINGS

In the detailed description of the preferred embodiments of the invention presented below, reference is made to the accompanying drawings, in which.

DETAILED DESCRIPTION OF THE PREFERRED EMBODIMENTS

The description of the present invention will be directed in particular to elements forming part of or cooperating more directly with apparatus in accordance with the present invention. It is to be understood that elements not specifically shown or described may take various forms well known to those skilled in the art.

Figure 1:
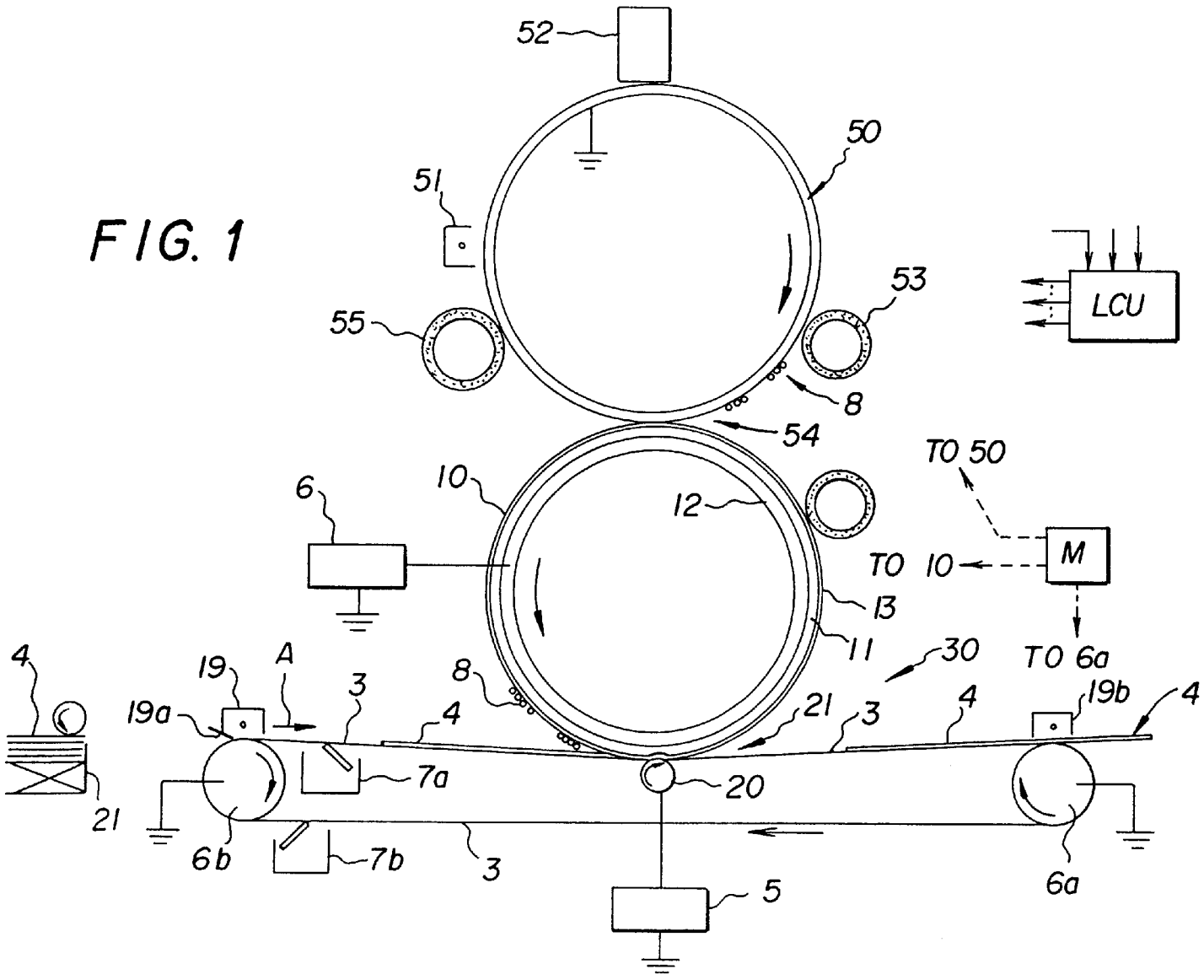
FIGS. 1, 3 and 4 are each side elevational views in schematic form of electrostatographic reproduction apparatus in accordance with the invention.
Figure 4:
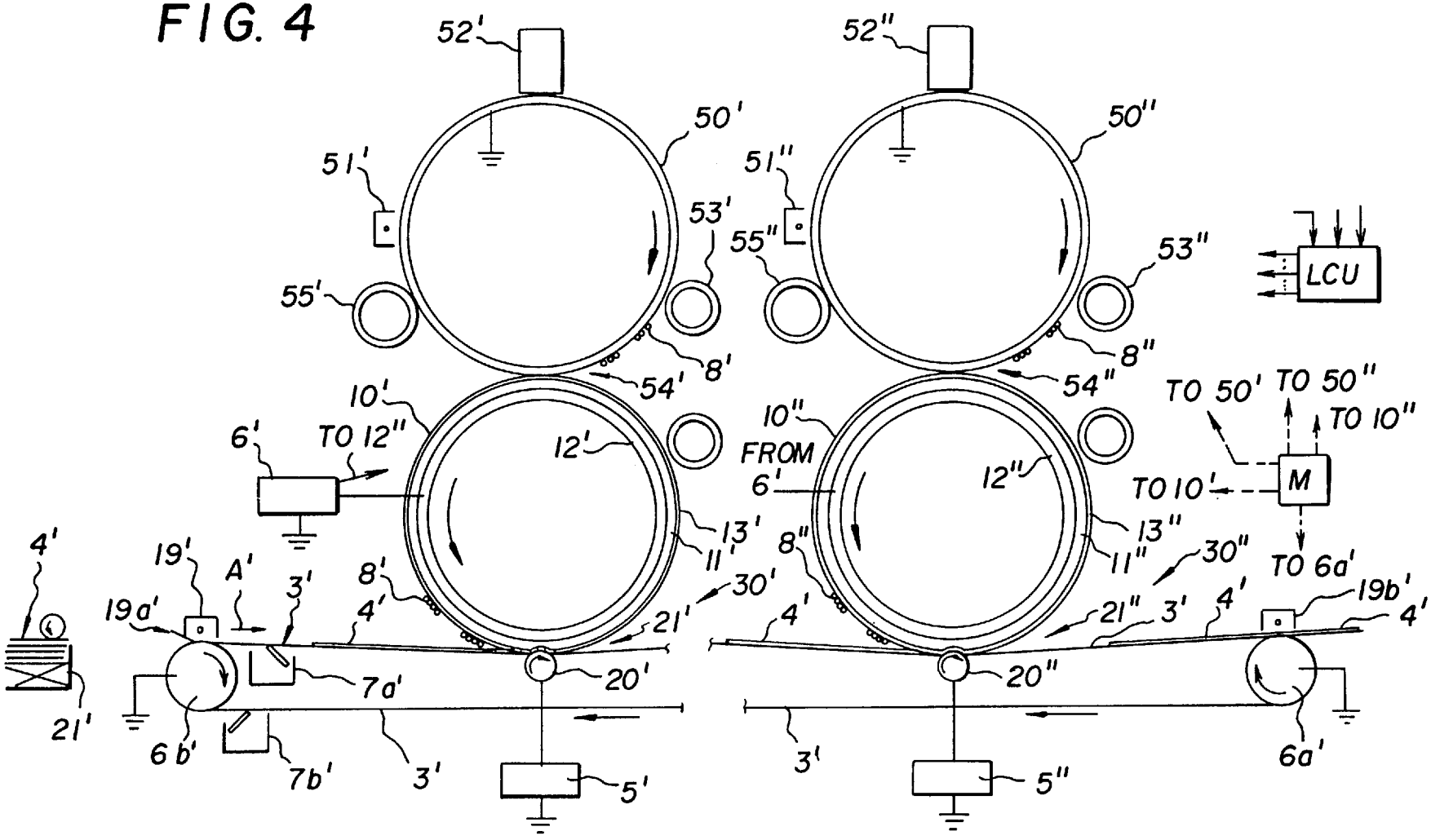

FIG. 1 is a sketch of an electrostatographic apparatus for forming images using electrostatic transfer. In this instance, the TBCIM comprises an intermediate transfer member. A transfer station 30 includes an intermediate transfer member (ITM) in the form of a drum 10, shown rotating counterclockwise, and a transfer backing roller 20 shown rotating clockwise. The intermediate transfer member 10 comprises a conductive drum 12 biased by power supply 6 and coated with one or more elastomeric layers 11, and the potential provided by power supply 6 is of a polarity suited for transfer of the toner particles from the preferably grounded primary imaging member 50 to the ITM. The compliant layer is greater than lmm in thickness and typically up to about 20 mm in thickness; preferably, it is between about 2 mm and about 15 mm in thickness. The Young's modulus of the material forming the compliant layer is greater than 0.5 MPa and less than about 50 MPa. Preferably, the Young's modulus is between about 1 MPa and about 5 MPa. A thin hard overcoat layer 13 is preferably provided about the compliant blanket layer. The hard overcoat is formed of a material having a Young's modulus greater than that of the compliant blanket layer and is preferably greater than 100 MPa. The hard overcoat may comprise small particles. The thickness of the hard overcoat layer is preferably between 2 $\mu$m and 30 $\mu$m. If drum 12 is nonconductive, a conductive layer (not shown) is coated under layer(s) 11 and connected to power supply 6. When the intermediate transfer member 10 is compliant, layer 11 may be, for example, a compliant, electrically semiconducting (resistivity of $10^6$ to $10^{12}$ ohm-cm) blanket. An endless transport web 3 moves a receiver sheet 4 towards and through a transfer nip in the direction of the arrow A. Transfer backing roller 20 may comprise a conductive drum and an optional compliant blanket layer coating overlying the conductive drum. The conductive drum of the backing roller 20 is biased to a suitable potential (500–5000 volts) provided by a high voltage power supply 5. The polarity of power supply 5 is opposite to the polarity of toner particle image 8 on the intermediate transfer member (ITM) 10, so that the electric field in the transfer nip urges the toner image on the ITM to transfer to receiver sheet 4. Receiver sheet 4 is temporarily attached to endless transport web or belt 3, e.g., by a suitable means such as grippers (not shown) or by an electrostatic attraction which is established by spraying or depositing charge on the receiver member such as by corona charger 19. In a multicolor process, a series of color transfer stations each similar to the one illustrated in FIG. 1 can be used to build up the final output color print by serially transferring individual color separation toner images in registry to receiver sheet 4 as receiver sheet 4 advances to each color transfer station while being carried upon an elongated transport web 3. Examples of a color printer using a multicolor process of this type are disclosed in U.S. application Ser. No. 08/900,696 filed Jul. 25, 1997 in the names of Thomas N.Tombs and Bruce R. Benwood, the contents of which are incorporated herein by reference and which has a corresponding published international application WO 98/04961. A schematic of a two-color process wherein two-color transfer stations 30', 30" are provided is illustrated in FIG. 4 wherein similar structures to that shown in FIG. 1 are identified with a single prime (') and double prime ("), respectively. A receiver sheet carried by web 3' thus receives one color image transferred to it at station 30' and a second color transferred to it in register with the first color at station 30". As shown in FIG. 4, the transfer stations can be operated simultaneously to provide transfer of images to different receiver sheets 4'. After transfer of all toner images to the receiver sheet, the sheet may be passed to a fusing station (not shown) wherein the toner image is fused to the sheet. In order to facilitate removal of the sheet 4' from the belt 3 or 3', a detack charger **19*b* or 19*b*' is provided for charging the sheet to neutralize the electrostatic charge holding the sheet to the belt 3 or 3'. While only two-color transfer is shown in FIG. 4**, it will be apparent that additional stations may be provided to provide additional color images that can be registered together on a receiver sheet as it moves from transfer station to transfer station. After the receiver sheet leaves one transfer station, the LCU adjusts the nip spacing in the next transfer station that is appropriate for the receiver sheet's thickness.

In the example of FIG. 1, a toner image is formed on a primary image forming member which is in the form of a drum 50. The drum includes a photoconductive layer or layers at or near the surface of the drum. In some cases, it is preferred to provide a thin insulative coating on the photoconductive layer. A primary charger such as corona charger 51 deposits primary electrostatic charge on the drum's outer surface. The drum 50 also includes a conductive layer which is preferably electrically grounded. The primary electrostatic charge may be imagewise modulated at an exposure station by an exposure source 52, which is preferably an LED or laser exposure source or an optical exposure source. Other known imaging exposure sources may also be used and other processing for forming a toner image may be provided including electrographic recording. In the preferred embodiment , the exposure source forms a latent electrostatic image that is developed at development station 53 to form a toner image 8. A preferred development station is of the SPD type as described by Miskinis in IS & T's Sixth International Congress on Advances in Non-Impact Printing Technologies, pages 101–110, published in 1990. Although only one development station is illustrated, the invention contemplates that plural development stations may be provided wherein different color separation images are formed on the primary image member, developed and transferred in regisbe used to form a multicolor image can be used to form a multicolor image are so transferred, the multicolor image can then be transferred to the receiver sheet. The toner image 8 is electrostatically transferred to the ITM 10 by electrostatic attraction of the toner to the surface layer 13 by the electrical field in the nip 54 between the intermediate transfer member and the primary image forming member. The surface of the drum 50 is then cleaned at a cleaning station 55 for reuse in forming the next toner image. Where multicolor images are built up on the ITM, the cleaning member may be moved away from the ITM until after transfer of the multicolored image to the receiver sheet has occurred. Receiver sheets 4 are serially fed in timed relation with generation of images on the drum 50 so that the images are properly registered on the sheets when transferred. The receiver sheets may be stored in a tray 21 or be manually fed into the print engine. Typically, registration rollers or other devices (not shown) may be provided for synchronizing movement of the sheets onto the belt 3. The charger 19 may be provided with a guide plate 19*a* for guiding the receiver sheet and holding the sheet in intimate engagement with the belt so that air is removed from between the sheet and the belt. Cleaning blades 7*a*, 7*b* may be provided for cleaning the inner and outer surfaces of the belt 3. The belt is between 20 $\mu$m and 100 $\mu$m in thickness, preferably about 50 $\mu$m–200 $\mu$m in thickness, and may be multilayered. A layer of the belt 3 is preferably insulated and has a resistivity of greater than $1\times10^{12}$ ohm-cm. Where the belt is not used to electrostatically hold the receiver sheet to the belt, the belt may have a resistivity greater than about $10^5$ ohm-cm. The belt is entrained about rollers 6*a*, 6*b*, one of which may be driven by motor M. Drive from motor M may also be provided to the other members. The rollers 6*a*, 6*b* are spring-tensioned apart to provide a tension in the belt 3 which causes the belt to maintain at least some wrap about the ITM 10. During transfer, transfer backing roller 20 engages the inner surface of the transfer belt 3 and urges the belt to press the portion of receiver sheet in the nip against the ITM under a pressure of preferably at least about 1 lb./in$^2$.

It is evident that when receiver sheet 4 enters a transfer nip having no gap (members 10 and 20 in pressing relationship with each other through belt 3), there will be an impulse force transferred to the intermediate transfer member 10 and the transfer backing roller 20. This force acts in a direction that tends to open the jaws of the nip. This impulse force is directly related to the thickness of the receiver sheet, and is largest for the thickest stocks. If drum 10 and roller 20 are both on fixed centers, the stress of this impulse force must be accommodated by compressive strains in the respective elastomer layers on member 10 and roller 20. For typical elastomeric coating materials, the material will appear rigid or glassy under the loads associated with the impact caused by the receiver sheet 4 entering the transfer nip. This impact could momentarily slow or even stop the electrophotographic engine, thereby causing misregistration of the separations as well as causing other image artifacts. Moreover, the stress generated by the impact could cause undue strain on the members supporting the intermediate transfer member and associated hardware, thereby shortening its life. Finally, if the receiver sheet is too thick, it may not even be possible to feed it through the transfer system, thereby precluding the ability to use the device for as large a range of receivers as would desirably be possible.

The present invention provides means to alleviate or eliminate impulse forces when receiver sheets, especially thick stocks, are successively passed through a transfer station.

The invention describes methods and apparatus to provide pre-transfer sensing of the thicknesses of receiver sheets, in combination with mechanical or electromechanical means to adjust the separation of the jaws of a transfer nip such that there is a negligible impulse force acting on each receiver sheet as it passes through the transfer station. If paper stock thickness is changed within a job stream, e.g., when document covers are printed, then the adjustment of the separation of the jaws must be done during the interframe time. For example, for an interframe width of 1" and a process speed of 20 ips, the gap adjustment must be accomplished in less than 50 ms.

Thicknesses of receiver sheets are measured in real time at a location separate from any transfer station. Typically, cut stock is loaded into a tray or other storage means 21 from which individual sheets are transported to a transfer station. Where sheets of different types, i.e. covers and thinner paper copy sheets are to be provided, separate trays may be provided and feeders for feeding the appropriate sheet are provided as is well known. A sheet thickness measuring station is located upstream from the first transfer station. The measured value of sheet thickness or other parameter related to sheet thickness such as a thickness difference from a nominal sheet thickness or change in combined thickness of belt 3 and receiver sheet 4 is transmitted mechanically or electrically to an actuator located in each of the toner image to sheet transfer stations of an electrophotographic machine, whereupon the actuator adjusts the gap spacing in sheet transfer nip 21 accordingly, e.g., by adjusting the position of the axis of the ITM 10 or the backing roller 20 shown in FIG. 1. Where as noted above, plural toner image to sheet transfer stations are provided as in FIG. 4 the respective nips 21' and 21" are adjusted in sequential timed relationship in response to timing signals from the LCU. This adjustment makes the gap spacing of each transfer station suitable for each receiver sheet currently in a transfer nip, i.e., by adjusting the gap spacing to provide a predetermined transfer pressure when a respective receiver sheet is in a respective transfer nip, while not imparting undesirable impulse forces as a sheet enters or leaves the transfer nip.

Figure 2:
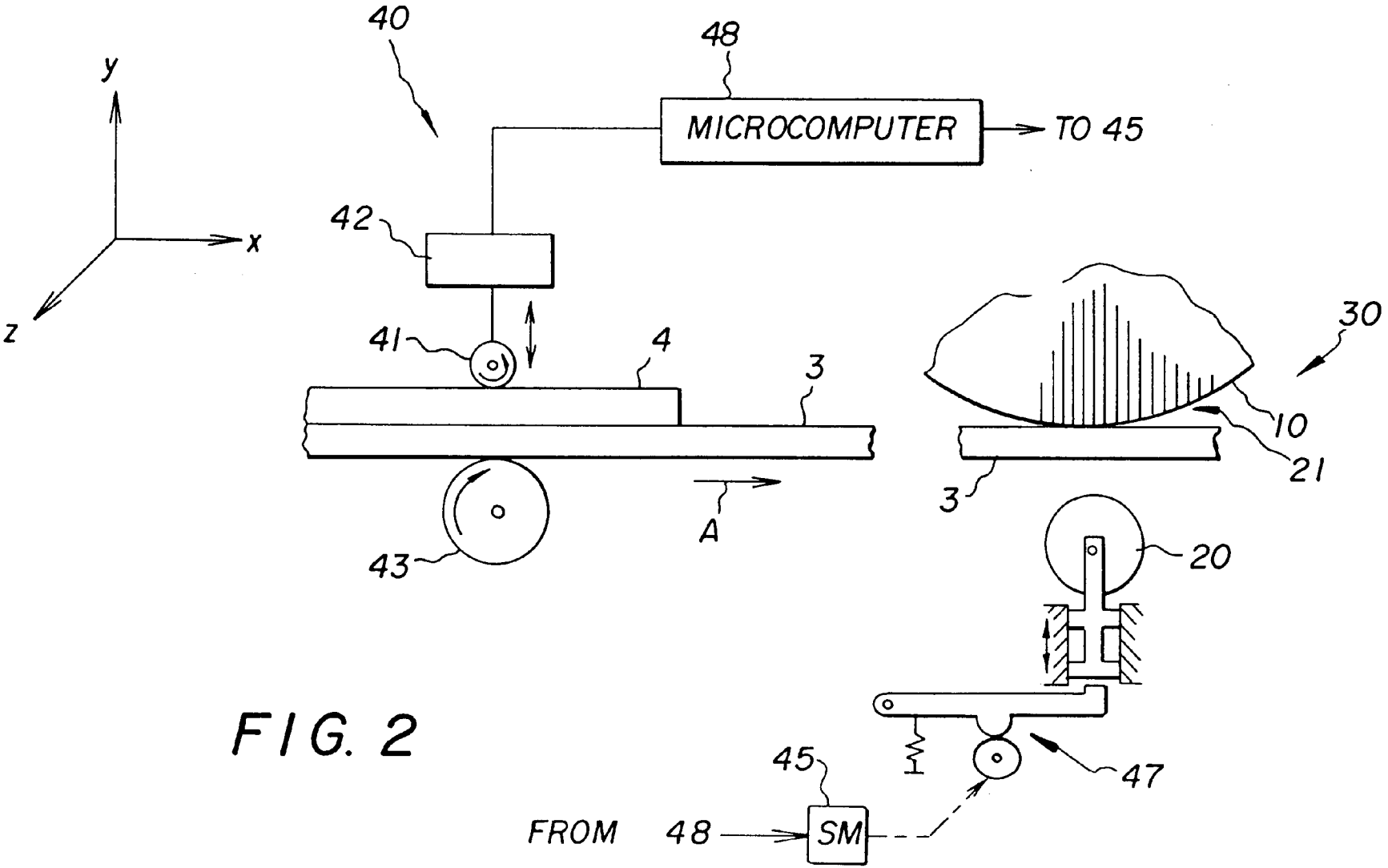
FIG. 2 is a schematic of a thickness measuring sensor and nip gap adjustment device for use in the apparatus of FIGS. 1 and 3.

The gap adjustment as described herein can be done on a sheet-by-sheet basis, or on a job-by-job basis when differing stock thickness may be used for each job. When adjustment is done on a job-by-job basis, it need not be done for each sheet, and the transfer nip gap widths of all the transfer stations can be adjusted at the beginning of each job, and kept the same without further adjustment for the duration of each job run. An apparatus for automatically adjusting for thickness of a sheet is shown in FIG. 2, which illustrates a thickness measuring station (TMS) 40 located upstream from the first transfer station 30. The transport web or belt 3 carrying a not-yet-toned receiver sheet 4 moves left to right as shown by the arrow A, parallel to the x-axis which forms a right angle with both the y- and z-axes. The thicknesses of the transport web and receiver sheet are shown greatly exaggerated in size relative to the other members in FIG. 2. A sensing roller 41, shown rotating counter-clockwise, rides over sheet 4. An optional backup roller 43, shown rotating clockwise, preferably on a fixed center, may also be employed. The axis of roller 41 is parallel to the z-axis. The axle housing of roller 41 is mechanically constrained to move parallel to the y-axis when passing over the leading and trailing edges of receiver sheet 4. (It will be obvious that motion along some direction other than the y-axis in the xy plane could be detected, but with lowered sensitivity). After roller 41 rides up on receiver sheet 4 and rolls along it, minimal compression of the receiver sheet is desirable if subsequent thickness reduction due to compression in the transfer nip can be accounted for. However, barring the ability to make such a correction, it is preferred that the resulting pressure of the roller 41 pressing on receiver sheet 4 is close to the pressure in the transfer nip (predetermined). Up and down motion parallel to the y-axis of the axle of roller 41 is sensed by displacement detector 42. By mechanical linkage or by electromechanical coupling, a displacement along the y-axis measured by displacement detector 42 is translated into a corresponding motion that increases or decreases transfer station gap widths as required in order to produce optimal transfer gap widths for different receiver stocks. When displacement measurements are done in the TMS on a sheet-by-sheet basis, adjustments of roller axis positions in the respective transfer stations downstream must be done in the interframe times. Each arrival at the TMS of a receiver sheet of a different thickness stock is effectively clocked through all successive transfer stations. This is done for sheet-to-sheet changes of thickness , or at the start of job-to-job changes of thickness.

In this mode of operation, the displacement detector can be a piezoelectric sensor. The electrical signal output by such a sensor operating as a mechanical to electrical transducer, may be proportional to the stress applied to the sensor and thus is related to thickness of a receiver sheet. As an alternative, a flexible piezoelectric device or flap such as a bimorph (typically fabricated from polyvinylidene fluoride) can be used as the transducer. An example of a piezoelectric flexure mode device is described in U.S. Pat. No. 4,342,936 by Michael A. Marcus et al. Thus, movement of a receiver sheet against the flap-like device may be used to cause deflection of a free end of the cantilevered supported flap to generate an electrical signal related to receiver sheet thickness. This signal may be input to one leg of an electrical bridge circuit. A second leg of the electrical bridge circuit has input thereto a signal related to position of the axis of roller 20. Through appropriate known electronics, a stepper motor drive 45 can be electrically connected to the output of the bridge so as to position the axis of roller 20 until a null voltage is detected which represents movement of the roller to a position appropriate for accommodating a receiver sheet in the transfer nip at a suitable pressure.

An alternative approach to detecting the position of the displacement detector would involve the use of a spring loaded force gauge. The change in force sensed though such a device could be hooked up through a series of levers to the transfer intermediate hardware so as to offset the force exerted by the displacement sensor at balance.

Alternatively, the thickness and position of the receiver can be sensed ultrasonically. In this instance an ultrasonic wave is generated at some source some distance greater than the thickness of the widest receiver to be used and the time needed for the ultrasonic pulse to traverse the distance is measured. Knowing the speed of sound in air, the separation distance and, therefore, the receiver thickness, can readily be determined. A particular method of sensing such distances would require that the ultrasonic source generate relatively short pulses and that the reflected pulses be superimposed at a detector. At the correct frequency, the power would be maximized. By knowing the pulse generation frequency, the time needed for the pulse to traverse the separation distance (which is the reciprocal of the frequency) would be known and the thickness of the receiver determined and a signal representing such thickness or a parameter related thereto generated.

In another embodiment of this invention, the displacement sensor comprises a rheostat. The preferred mode of operation would be to use the rheostat as a leg of a bridge circuit, with a corresponding rheostat forming a second leg to which through appropriate known electronics a drive to a stepper motor is actuated. The motor would then position the appropriate member of the intermediate device until a chosen voltage, preferable null, is reached across the bridge.

The preferred embodiment comprises an LVDT (linear variable differential transformer), to sense receiver sheet thickness. An LVDT with appropriate signal conditioning circuitry puts out a voltage that is proportional to the displacement of the LVDT's shaft. This LVDT could contact the receiver sheet directly or it could be connected to a roller, 41, which rides on the back of the receiver. The LVDT would be connected, through appropriate signal conditioning circuitry to a microcomputer 48 which could be the main logic and control unit (LCU) of the electrophotographic machine or it could be a microcomputer dedicated to this purpose. The microcomputer may contain one or more microprocessors. Programming of a number of commercially available microprocessors is a conventional skill well understood in the art. This disclosure is written to enable a programmer having ordinary skill in the art to produce an appropriate control program for the microprocessor(s). The particular details of any such program would, of course, depend on the architecture of the designated microprocessor. The microcomputer would contain or have connected thereto an A/D (analog to digital) converter which would read the voltage output from the signal conditioning circuitry. This voltage, which is proportional to the receiver's thickness, would then be used to determine the gap to be set between the ITM, or each of the ITM's where plural toner image to receiver sheet nips are provided, and their respective transfer backing rollers. This gap would be set by a command from the microcomputer 48 to the stepper motor 45 with appropriate driver which, through an arrangement of, for example, cams and levers 47 or other known mechanical means moves the appropriate transfer backing roller 20 vertically either up or down.

Of course, there are numerous other ways to implement this function. Instead of the LVDT, an ultrasonic or laser thickness sensor could be used. These sensors are well known and commonly available. Example of sensors using IR or other spectrums of light to determine thickness of a receiver sheet are described in U.S. Pat. Nos. 5,127,643 and 5,138,178 and also may be used assuming compositional similarity of the paper. These same functions could also be implemented with a linear potentiometer or linear optical encoder. A rotary potentiometer or optical encoder can be used with an arm mounted to the shaft and a wheel mounted on the other end of the arm. The wheel would be allowed to ride on the transport belt such that when a receiver comes along the wheel would move up in the y direction which would, in turn, rotate the shaft of the encoder of potentiometer. These rotary signals could then be interpreted into receiver thicknesses by the microcomputer.

One can also sense the thickness of the receiver sheet by use of a spring-loaded force gauge. The force produced by the thickness of the receiver sheet could be measured with strain gauges, either singularly or in various bridge arrangements, or a load cell, or other force transducer.

The functions of the microcomputer could also be performed by dedicated circuitry, either analog or digital, which would receive the sensor signal and command the step motor or other appropriate actuator. In fact, the entire mechanism could be implemented mechanically with a system of levers and cams which would transmit the position displacement of the sensing element or the force on the sensing element directly to the transfer zone spacing or force respectively.

Instead of a stepper motor to set the transfer gap width, one could use a motor with position feedback which could be controlled by the microcomputer or other types of servo loops. Linear electromagnetic and piezoelectric actuators are well known and could be used in this application.

By measuring the separation distances frequently compared to the time necessary for the receiver sheet to traverse the transfer nip region, this device could also be used for repositioning the TBCIM or associated hardware at the time that the receiver sheet exits the nip. This repositioning can be made more gentle to avoid the TBCIM device impacting other members of the electrophotographic engine.

Although the TBCIM can be the member repositioned as discussed above, it is preferable to reposition the transfer support backing roller 20. This is because the backing roller is less massive in general and, therefore, easier to reposition. Moreover, the backing roller generally does not have the constraints on its position due to engine configuration that the TBCIM has.

Figure 3:
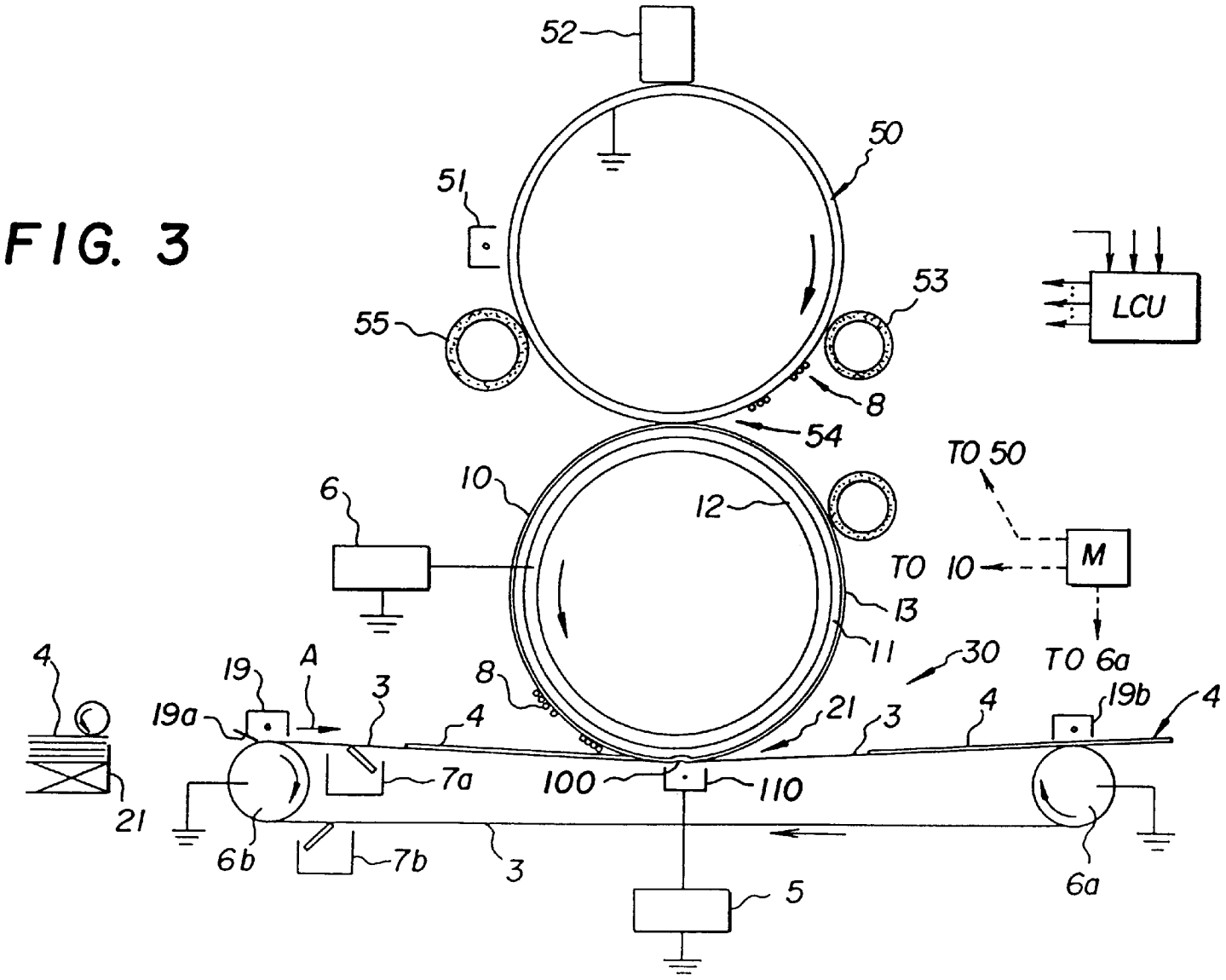

In the embodiment of FIG. 3, like numbers refer to similar parts shown in FIG. 1. The only difference between the two embodiments is the use of a corona charger 110 and an associated element 100 which presses against the back surface of the belt 3 and urges the belt and thus the receiver sheet into increased pressure engagement with the ITM 10 at nip 21. Element 100 can comprise a plate. Alternatively, element 100 can be flexible or comprise a series of flexible members or rigid plates or a brush. The gap spacing between element 100 and the ITM 10 is adjusted in response to detection of receiver sheet thickness to minimize impact force when the receiver sheet enters the transfer nip 21. The corona charger is connected to power supply 5*a* for energizing the charger to generate charge suited for transfer of the toner image to the receiver sheet.

When mechanical feedback from displacement detector 42 is used to adjust the interaxial spacing between the TBCIM and back-up the transfer backing member, it is preferable to damp the motion of roller 41 parallel to the y-axis by any suitable means, in order to prevent undue stress on the mechanical feedback mechanism, which may comprise, for example, gears, cams, levers and so forth.

In the embodiments described above, the belt 3 may be eliminated. Other types of transfer in addition to or besides electrostatic transfer may be provided. For example, the transfer may be under heat and pressure with or without electrostatic assistance to partially fuse or completely fuse the toner as it is transferred to the receiver sheet. The primary image forming member and/or the intermediate transfer member may be in the form of a web or belt. The development is preferably xerographic using dry toner particles; however, the invention is also applicable to liquid toners. The fusing of the image to the receiver sheet may be complete upon transfer or preferably be provided downstream of transfer as is well known. The primary image may be formed by means other than electrostatography including ink jet and other known image creation modes that require subsequent transfer of an image under pressure to a receiver sheet.

The invention has been described in detail with particular reference to preferred embodiments thereof, but it will be understood that variations and modifications can be effected within the spirit and scope of the invention.

What is claimed is:

1. An image recording apparatus comprising:

a toner image bearing member the toner image bearing member having a compliant layer that has a Young's modulus of between 0.5 MPa and 50 MPa and the laver is at least 1 mm in thickness;

a transfer backing member that applies pressure to a receiver member that is in engagement with the toner image bearing member in a transfer nip for transfer of a toner image on the toner image bearing member to the receiver member;

a movable web is located in the nip and transporting the receiver member through the nip, the transfer backing member engagng the web and applying pressure to the web when the receiver member is in the nip;

a device for sensing a parameter related to thickness of the receiver member prior to movement of the receiver member into the nip; and an adjustment device responsive to sensing of the parameter for adjusting nip spacing between the toner image bearing member and the transfer backing member so as to facilitate entrance of the receiver member into the transfer nip and to eliminate or reduce impact associated with the receiver member entering the transfer nip.

2. The apparatus of claim 1 wherein the device that senses a parameter related to thickness is a sensor that generates an electrical signal and the adjustment device is responsive to the signal to adjust nip spacing.

3. The apparatus of claim 2 wherein the adjustment device includes a microprocessor.

4. The apparatus of claim 2 wherein the sensor includes a linear variable differential transformer.

5. The apparatus of claim 1 including a primary toner image forming member upon which a toner image is formed, the primary member forming a nip with the toner image bearing member which receives a toner image from the primary member.

6. The apparatus of claim 1 wherein the toner image bearing member (TIBM) and the transfer backing member comprise a first color transfer station and there is additionally provided a second TIBM and a second transfer backing member that applies pressure to a receiver member that is in engagement with the second TIBM in a second transfer nip for transfer of a second color toner image on the second TIBM to the receiver member and the movable web is located in the second nip and transports the receiver member through the second nip.

7. An electrostatographic recording method comprising:

forming a toner image on a toner image bearing member, the toner image bearing member having a compliant layer that has a Young's modulus of between 0.5 MPa and 10 MPa and the layer is at least 1 mm in thickness;

moving a receiver member into engagement with the toner image bearing member;

transferring the toner image to the receiver member in a nip formed in a space between the toner image bearing member and a transfer backing member;

wherein a movable web is located in the nip and transports the receiver member through the nip and the transfer backing member engages the web and applies pressure to the web when the receiver member is in the nip;

sensing a parameter related to the thickness of the receiver member prior to movement of the receiver member into the nip; and automatically adjusting, in response to sensing of the parameter, a spacing in the nip to facilitate entrance of the receiver member into the nip and to eliminate or reduce impacts associated with the receiver member entering the nip.

8. The method of claim 7 wherein in response to sensing the parameter related to thickness an electrical signal is generated and nip spacing is adjusted in response to the signal.

9. The method of claim 7 and including forming a toner image upon a primary toner image forming member and transferring the toner image to the toner image bearing member.

10. The method of claim 9 and wherein the toner image is developed using a developer with toner particles having a mean volume weighted diameter between 2 $\mu$m and about 9 $\mu$m.

11. The method of claim 7 and wherein the toner image is developed using a developer with toner particles having a mean volume weighted diameter between 2 $\mu$m and about 9 $\mu$m.

12. The method of claim 7 including adjusting, in response to sensing of the parameter, transfer nip spacings in plural transfer nips wherein a color image is transferred to the receiver member in each transfer nip.

13. The method of claim 7 wherein in sensing a parameter related to thickness a mechanical member is moved by the receiver member and the movement of the mechanical member is damped.

14. The method of claim 7 wherein the receiver member is of paper stock and wherein paper stock thickness is changed within a job stream when document covers are printed.

15. The method of claim 7 wherein the adjustment of the spacing of the nip is made during an interframe period.

16. An electrostatographic recording method comprising:

forming a toner image on a toner image bearing member, the toner image bearing member having a compliant layer that has a Young's modulus of between 0.5 MPa and 50 MPa and the layer is at least 1 mm in thickness;

moving a receiver member into engagement with the toner image bearing member;

transferring the toner image to the receiver member in a nip formed in a space between the toner image bearing member and a transfer backing member;

sensing a parameter related to the thickness of the receiver member prior to movement of the receiver member into the nip; and automatically adjusting, in response to sensing of the parameter, a spacing in the nip, and wherein the adjustment of the spacing of the nip is made during an interframe period and to facilitate the entrance of the receiver member into the transfer nip and to eliminate or reduce impact associated with the receiver member entering the transfer nip.

17. The method of claim 16 wherein a movable web is located in the nip and transports the receiver member through the nip and the transfer backing member engages the web and applies pressure to the web when the receiver member is in the nip.

* * * * *